US005815881A

United States Patent [19]

Sjögreen

[11] Patent Number: 5,815,881

[45] Date of Patent: Oct. 6, 1998

[54] UNIVERSAL VACUUM CLEANER

[76] Inventor: Jörgen Sjögreen, Dybesövej 60, Rörvig, Denmark, DK-4581

[21] Appl. No.: 633,720

[22] PCT Filed: Oct. 24, 1994

[86] PCT No.: PCT/DK94/00390

§ 371 Date: Apr. 15, 1996

§ 102(e) Date: Apr. 15, 1996

[87] PCT Pub. No.: WO95/10972

PCT Pub. Date: Apr. 27, 1995

[30] Foreign Application Priority Data

Oct. 22, 1993 [DK] Denmark ..... 1190/93

[51] Int. Cl.[6] ..... A47L 9/16; A47L 9/18; B01D 47/06

[52] U.S. Cl. ..... 15/321; 15/320; 15/353

[58] Field of Search ..... 15/320, 321, 353; 55/223, 229, 237, 239, 250, 257.4

[56] References Cited

U.S. PATENT DOCUMENTS

| | | | |
|---|---|---|---|
| 2,250,226 | 7/1941 | Juelson | 55/237 |
| 3,842,461 | 10/1974 | Wurster | 15/353 |
| 4,366,132 | 12/1982 | Holter et al. | 55/250 |
| 4,957,512 | 9/1990 | Denisov et al. | 55/223 |
| 5,021,095 | 6/1991 | Tamaki | 15/321 |
| 5,022,114 | 6/1991 | Kauffeldt et al. | 15/353 |
| 5,125,125 | 6/1992 | Barsacq | 15/353 |
| 5,465,455 | 11/1995 | Allen | 15/353 |

FOREIGN PATENT DOCUMENTS

| | | | |
|---|---|---|---|
| WO 93/03217 | 2/1993 | WIPO | 15/353 |

*Primary Examiner*—David Scherbel
*Assistant Examiner*—Terrence R. Till
*Attorney, Agent, or Firm*—Dick & Harris

[57] ABSTRACT

A universal vacuum cleaner comprising an inlet aperture, cylindrical top cover, a cylindrical liquid container, a centrally placed outlet pipe, a nozzle, a detachable pick up tray, an air pump, and a central outlet pipe. The cylindrical top cover is positioned on the cylindrical liquid container and includes an elbow member positioned therein, where the elbow member is positioned in association with the inlet aperture. The outlet pipe is positioned in the cylindrical top cover and includes a filter. The nozzle is positioned within the elbow member. The nozzle directs liquid tangentially into the cylindrical top cover. The detachable pick up tray is positioned within either the cylindrical top cover or the cylindrical liquid cover and includes a coarse filter. The air pump is associated with the centrally placed outlet pipe. The air pump is capable of pulling air and foreign matter through the universal vacuum cleaner. The liquid pump is associated with the nozzle and the cylindrical liquid container, wherein the liquid pump is capable of pumping liquid from the liquid container through the nozzle.

15 Claims, 5 Drawing Sheets

Fig. 1
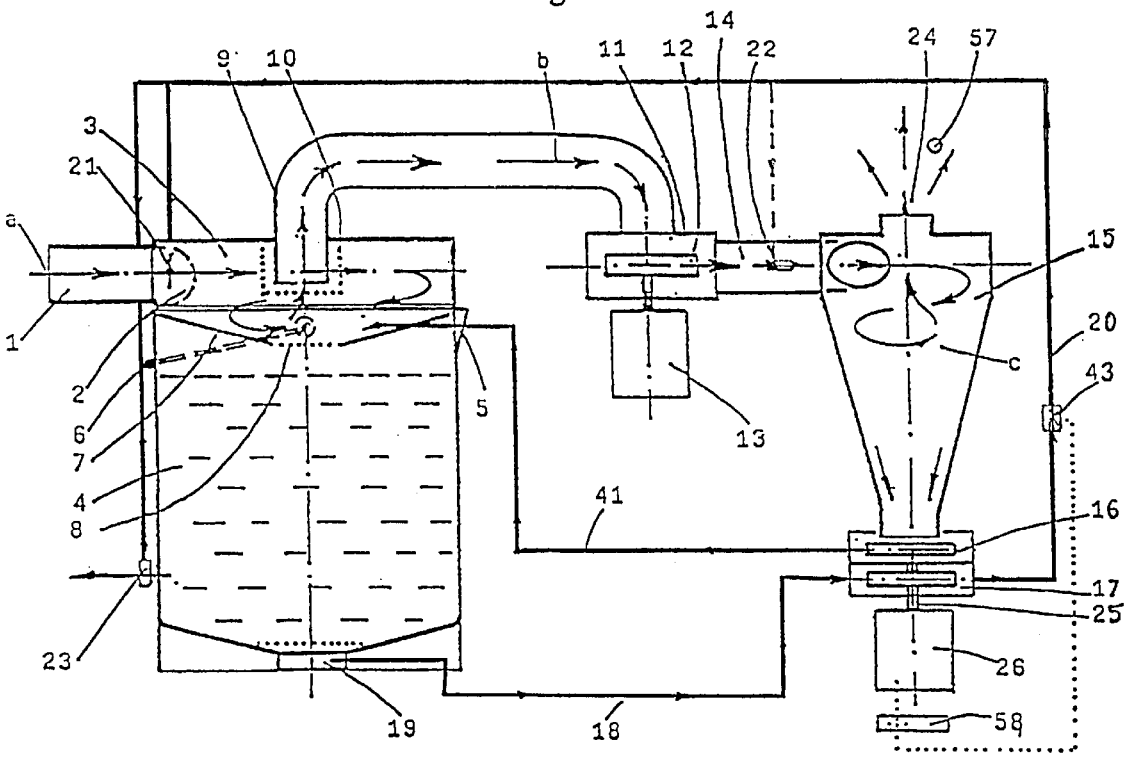
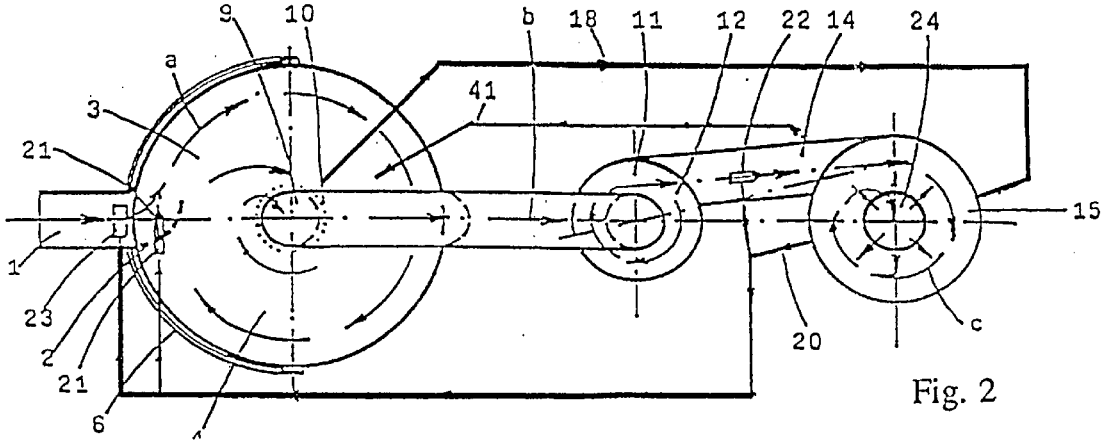
Fig. 2

Fig. 9
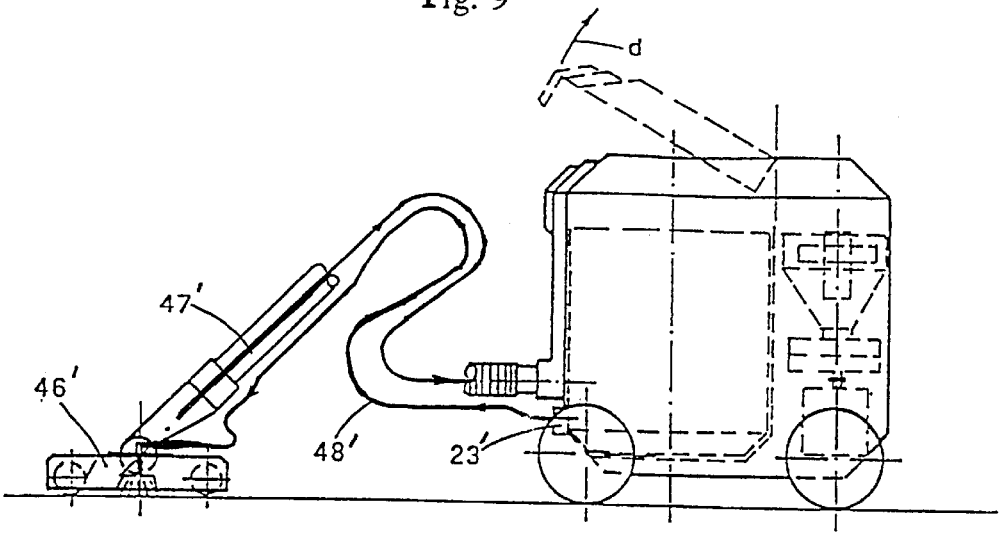
Fig. 10
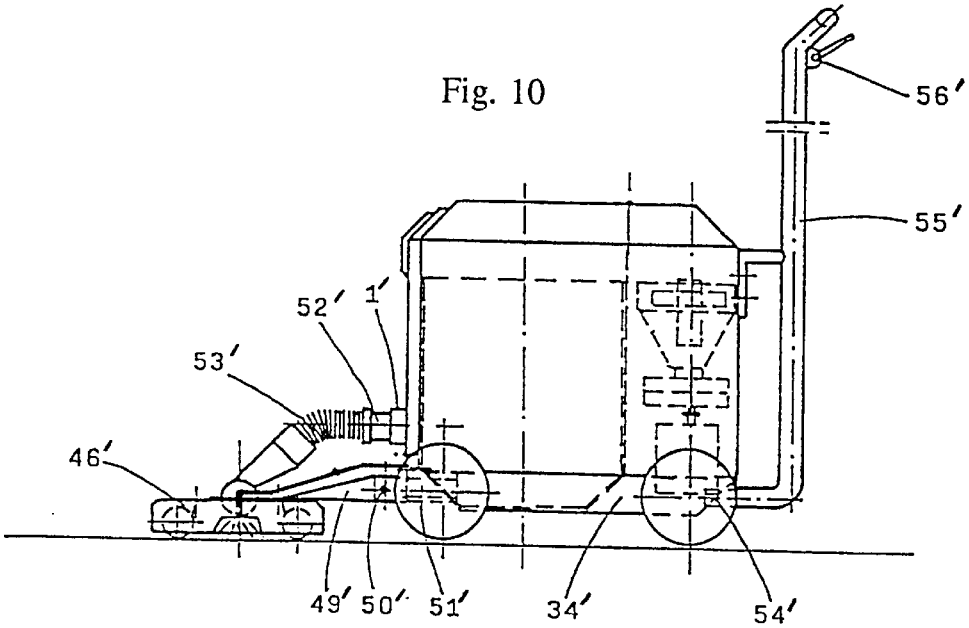
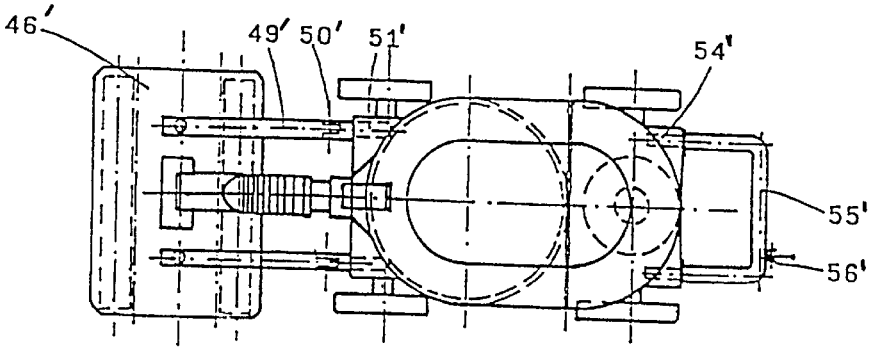
Fig. 11

UNIVERSAL VACUUM CLEANER

BACKGROUND OF THE INVENTION

1. Field of the Invention

The invention relates to an universal vacuum cleaner, and more specifically to a universal vacuum cleaner in which, the user does not need to disassemble or to exchange parts in the cleaner, to accomplish any one of ordinary dry vacuum cleaning, wet vacuum cleaning of a moist underlay, absorption of water on floors, carpet cleaning, ordinary floor washing and sucking up water from kitchen sinks, toilet sinks or the like. The universal vacuum cleaner uses liquid as a filter wherein liquid with dirt and impurities are separated from the air and the clean air is, free from dust and of a suitable degree of relative humidity, exhausted and the liquid with the dirt accumulated in a liquid container. The container can be emptied, filled up with clean liquid and reinstalled in the vacuum cleaner.

2. Background Art

There is an increasing demand for using liquid detergent on carpets and the like, as users, to a greater extent, have become aware of the health benefits relative, of removing accumulations of dust, bacteria and microorganisms hidden in the carpet pile. Such accumulations are difficult to control by means of ordinary dry vacuum cleaning. Many have shied away from carpeting because of such problems. However, it can be presumed, the amount of dust and dirt that settles, is the same, regardless of whether the floors are covered with carpet or with hard boards. Thus, the use of carpeting, which trap such impurities, would be more acceptable if the user had efficient equipment to remove and neutralize those impurities, for instance through the use of wet vacuum cleaning with liquid, having suitable detergents and disinfectants. Further, by wet-washing the air, before it is exhausted from such a vacuum cleaner, a more healthy and comfortable indoor climate can be achieved.

The known vacuum cleaners can generally be divided in the following main groups: the ordinary dry vacuum cleaners which only are intended for vacuuming water, the type of vacuum cleaners which after disassembly and change over, can be used for both dry and wet vacuum cleaning through the application of liquid on the underlay, and the type of vacuum cleaners, known as carpet cleaners, which are usable for carpet cleaning with shampoo, and, not usable for ordinary dry vacuum cleaning.

In those cleaners that require change-overs, where the user wants to change from dry vacuum cleaning to wet vacuum cleaning or wants to vacuum water, it would require dismantling and changing of parts in the vacuum cleaner. Where waterproof filters are used, they may become clogged entirely if the suction air contains unfavorable mixtures of dirt and water, which form sludge sediments. If the vacuum cleaner is to be used for dry vacuum cleaning, after it has been used for wet vacuum cleaning, it has to be completely dry inside, otherwise the dry dust may cleave to the wet parts inside the vacuum cleaner. These rather troublesome procedures limit the use of wet vacuum cleaning and spot cleaning in a user's daily house cleaning.

Danish patent application no. DK 4838/73 teaches a floor cleaning machine which is claimed to be usable to vacuum dust and liquid. In accordance with the claims of the reference, a cyclone of known design and a blowing motor unit are placed beside each other in order to reduce built-in height of the unit. The blowing motor unit pulls the air through a filter before it is exhausted to the surroundings. The claimed qualities are obtained by using known methods.

German patent no. DE 29 07 395 A1 teaches a suction aggregate including a container containing water as a filter. The container is divided into at least two sections by partitions, after which the sucked air is forced to flow through the water. The suction pressure is provided by an air pump, which is driven by a motor. The motor also dries a turbine wheel, the purpose of which is to free the air withdrawn from the water. The invention does not disclose facilities to pick up foreign matters which are heavier than water (and therefore will settle), nor those, lighter than water that tend to float on the surface of the water. Additionally, the invention does not disclose facilities for applying liquids during vacuum cleaning.

Danish Patent no. DK 166427 B1 deals with accessories which can be connected to a vacuum cleaner. The purpose of the accessories is to vacuum and separate liquid by spot-cleaning a carpet. According to the invention, the separating chamber includes an open system of channels, which are restricted by walls. The geometrical shape of the separating chamber is not described in the claims or in the description, but seems to be circular. Accordingly, it appears that that the separation is procured by using the centrifugal force, which is known in the prior art.

SUMMARY OF THE INVENTION

By using a number of known systems and by composing and designing those in the manner described in the invention, a universal vacuum cleaner is procured, which includes the described qualities found in different units in a single vacuum cleaner.

This is achieved, according to the invention, by a universal vacuum cleaner wherein the forced circuit of suction air, containing dry or moist foreign matters or liquid, is exposed to one or more nozzles which inject liquid into the air stream preferably in the same direction as the air flow. The first nozzle is placed immediate after the inlet aperture in the entrance elbow in the cylindrical top cover. A detachable liquid container is placed below this structure. The top is provided with a detachable pick up tray, which includes a coarse filter, and the bottom of which is provided with a filter, from which a suction pipe is carried to a liquid pump and, in turn, by way of a pressure pipe, the liquid is carried to the nozzle, or nozzles, and finally to the hose coupling.

In a preferred embodiment the outlet pipe (with a filter) extends from the center of the top cover, and is carried over to the inlet port of an air pump. The outlet pipe where one or more of the nozzles is placed, leads the air stream tangential into the cyclone. The cyclone has an outlet opening in the top, and below the cyclone the liquid pump is positioned in such a way that the lower conical part of the cyclone joins the inlet port of the liquid pump, and the outlet pipe is carried to the pick up tray in the liquid container. In such preferred embodiment, the order in which the air pump and the cyclone are placed may be interchanged so the cyclone is placed before the air pump in the direction of the air stream.

In another preferred embodiment, the air pump is built integral with the cyclone. The turbine wheel is placed in the top of the cyclone, fitted to an axle, which is common with the liquid pumps below the cyclone, and driven by one or more electric motors, preferably one motor. The air escapes from the cyclone through an outlet pipe of suitable length, and it is carried up through the hub of the turbine wheel and fastened to the common axle by one or more hubs having spokes.

In another preferred embodiment, in which the air pump is build together with the cyclone, nozzles are not placed before the cyclone. The air pump is fitted on the top of the cylindrical top cover, so the pump inlet port is connected directly to the top cover outlet pipe. The cyclone is placed surrounding the pump with the pointed conical end upwards. The separated air escapes through the opening in the top of the cyclone, whereas dirt and moisture that are not separated in the top cover, are separated and drained through a hose leading to the container. Additionally, the pump house outlet is designed as a circular ring of gill-slits.

In yet another preferred embodiment of the invention, the universal vacuum cleaner may be provided with a pressure-water piping, carried forward to a hose coupling of known construction which is placed close to the inlet aperture. The pressure-water piping may be connected with the nozzle spray system in a vacuum cleaner nozzle, which is suitable for applying liquid to an underlay and it may be connected with the inlet aperture by means of suction pipes and hoses of known construction as well as a pressure-water hose.

In a preferred embodiment the end wherein the inlet aperture is placed, a built-in fitting device for a suspension is disposed. The device is turnable around a horizontal axis, and is spring loaded. The nozzle is therefore kept close against the underlay by a suitable pressure. Additionally, the nozzle is provided with a flexible hose and an adapter pipe, which may fit the inlet aperture.

In yet another preferred embodiment, in the opposite end of the inlet aperture built-in fitting device is positioned. A pushing device may be use, such as, for instance a pipe frame. It may be provided with operating handle that includes controls of the vacuum cleaner.

In another preferred embodiment, a control device of known construction is placed in the outlet opening, which records the relative humidity of the exhausted air and by means of a control box, to control the amount of liquid injected through the spray nozzles, and to obtain a predetermined and selected desired relative air humidity.

Other variations are likewise contemplated. For instance, for low-priced designs some of the above described elements can be omitted. For instance, the cyclone including its cleaning nozzle and humidity control can be omitted. Conversely, for more expensive machines, more nozzles and cyclones with more containers and larger containers, which can be drained and filled by means of hoses and pumps, may be used.

Additionally, where the universal vacuum cleaner is used in combination with an universal nozzle for vacuum cleaners such as those described in Danish patent application nos. DK 3015/90 and DK 0902/93, the vacuum cleaner can be used for spot-cleaning of, for instance, carpets. During normal dry dust cleaning one may come across a dirt spot on the carpet, which has to be removed. By operating an activating handle, a liquid detergent in sufficient amount may be applied to the carpet until the spot is dissolved. Subsequently, the moisture and liquid detergent is retracted to the liquid container. Once the spot is removed and the moisture vacuum, normal dust vacuum cleaning continues. By using the above mentioned universal nozzles, the universal vacuum cleaner may likewise be used for traditional floor washing.

BRIEF DESCRIPTION OF THE DRAWINGS

For a better understanding of the invention, reference is made to the enclosed diagrams and drawings, namely:

FIG. 1 of the drawings is a schematic side view of a first embodiment of the invention;

FIG. 2 of the drawings is a schematic top plan view of the first embodiment of the invention;

FIG. 9 of the drawings is a schematic side view of the second embodiment of the invention having a housing and a suction nozzle;

FIG. 10 of the drawings is a schematic side view of the second embodiment of the invention having a nozzle and a handle; and FIG. 11 of the drawings is a schematic top view of the second embodiment of the invention having a nozzle and a handle.

DETAILED DESCRIPTION OF THE INVENTION

Figure 3:
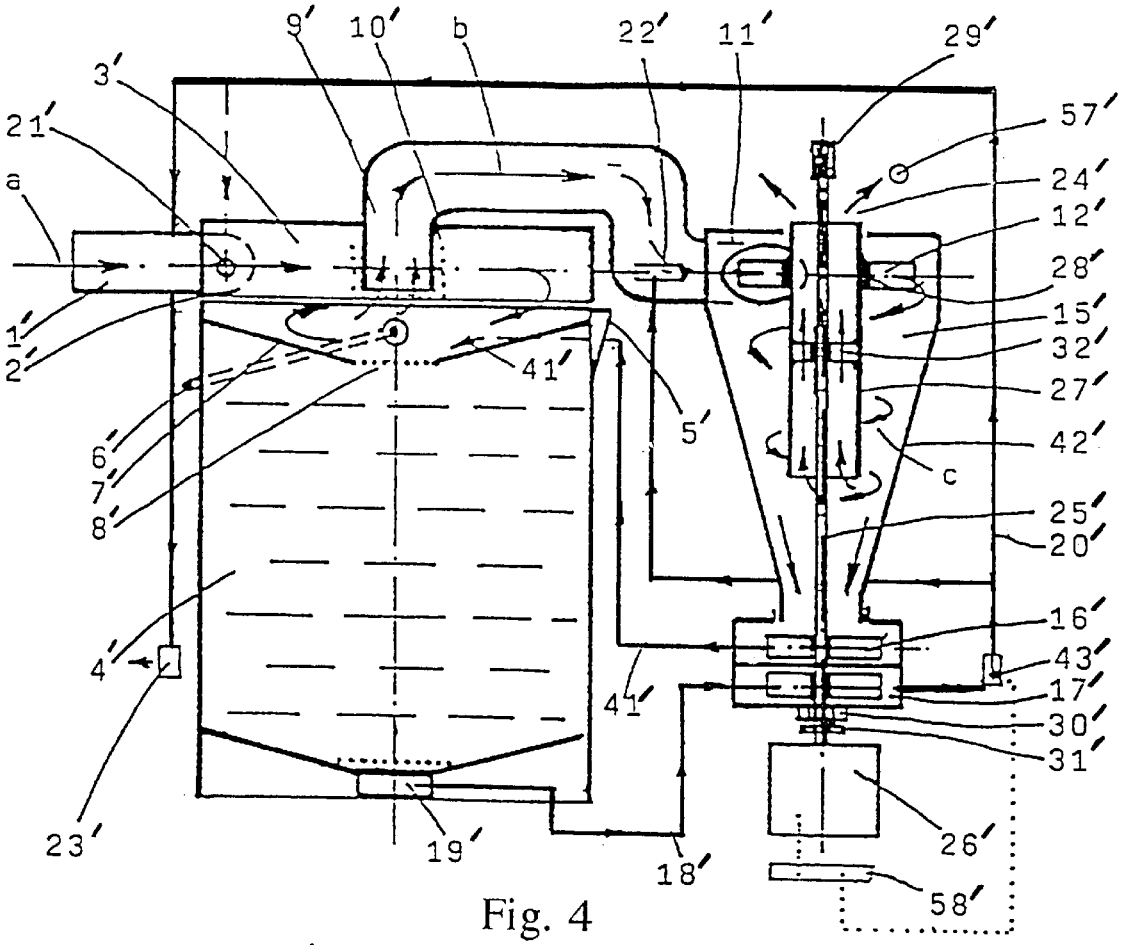
FIG. 3 of the drawings is a schematic side view of a second embodiment of the invention.
Figure 4:
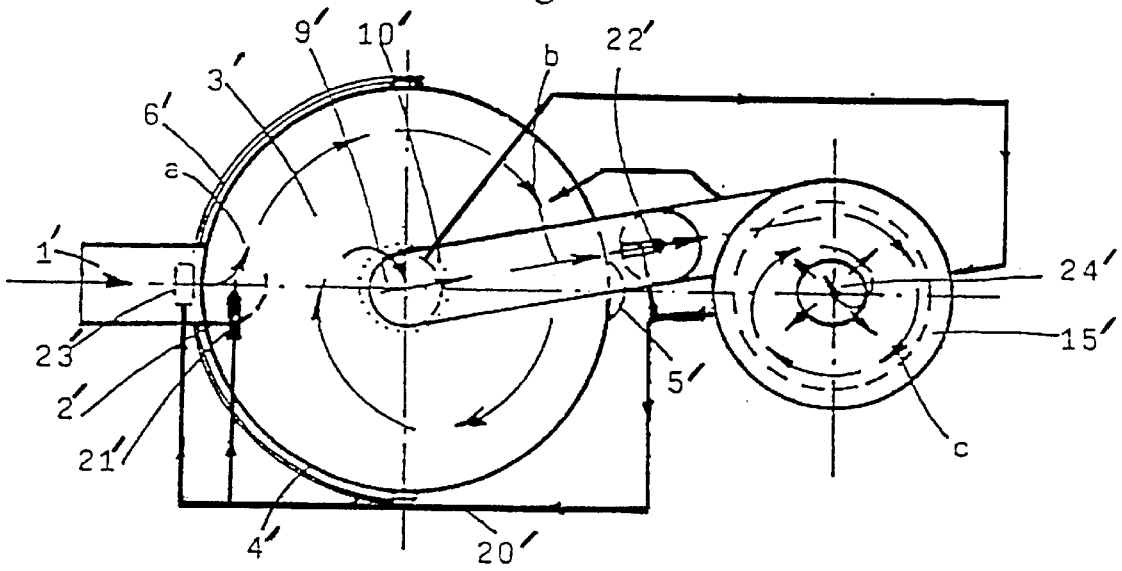
FIG. 4 of the drawings is a schematic top plan view of the second embodiment of the invention.

FIGS. 1 and 2 disclose a first embodiment of the invention. The air is sucked at inlet aperture 1, and directed by entrance elbow 2. Elbow 2 guides the air stream tangentially into cylindrical top cover 3. Thus the air is circulating inside cylindrical top cover 3 in the direction as indicated by the arrows of FIGS. 1 and 2. Foreign matters sucked in along with the air are soaked with liquid exiting from nozzle 21, which is placed immediately after the inlet aperture 1.

As shown in FIG. 1, interchangeable liquid container 4 with spout 5 and carrying handle 6 is positioned below the cylindrical top cover. Proximate the top of liquid container 4 pick up tray 7 having a coarse filter 8 which picks up course foreign matters as matches, coins, clips and the like is positioned. From the center of cylindrical top cover 3, outlet pipe 9, protected by filter 10, guides the air in the direction indicated by the arrows b, to the center of air pump 11 having turbine wheel 12, driven by electrical motor 13. The air pump creates the necessary vacuum.

The air is then forced from air pump 11 through pipe 14, tangentially into cyclone 15. This circulating is indicated by the arrows c. Through nozzle 22 further liquid is injected in order to insure that the mixture of water and foreign matters remains easy-flowing, so it can be pumped into the liquid container 4 and so that foreign matters do not adhere to the turbine wheel and cyclone.

By letting the system work without suction of foreign matters through inlet aperture 1, essentially the system partly is cleaning itself. Because of the centrifugal force, the liquid with the soaked foreign matters are hurled along the conical sides of the cyclone; subsequently, they slide down and accumulate in the liquid pump 16. Next, the liquid is pumped through pipe 41 into pick up tray 7 in liquid container 4 where it is accumulated. The cleaned air which has been separated escapes through opening 24 in the top of cyclone 15. The liquid pump 17, placed below the liquid pump 16 and driven by axle 25 and motor 26, sucks the liquid through suction piping 18 from the bottom of liquid container 4 through valve 19, and in turn, through the pressure piping 20 into nozzles 21 and 22. Furthermore, through a pressure piping it is carried to hose coupling 23, which is placed at inlet aperture 1 and which may be connected to a pressure hose, adapted to a nozzle for a vacuum cleaner which is usable to apply liquid to an underlay.

The liquid circulates and is filtered continuously during the use. The amount of liquid which is injected into the air stream, is of such a size, that all foreign matters are to some extent moistened and then fully separated in pick up tray 7 by means of course filter 8 or subsequently separated in cyclone 15. This is highly efficient as all the foreign matters are mixed by liquid, wherefore, they mainly are of the same specific gravity. The liquid pump 16 is of the type which is capable of pumping liquids containing foreign matters of a size which can pass through filter 10. All foreign matters will be accumulated, either in pick up tray 7 which may be emptied into a dustbin, or into the liquid in liquid container 4. When full, the liquid container may be emptied in a sink or a lavoratory. By means of injecting liquid through nozzles 21 and 22, combined with the fast revolving turbine wheel 12, substantially all foreign matters are mixed with liquid and separated from the air, and the air is, therefore, is totally free from dust when leaving cyclone 15 through opening 24.

Another embodiment of the invention is shown in FIGS. 3 an 4. Similar components having similar functions utilize in this and subsequent embodiments use the same reference numerals as those used in the first embodiment, augmented by a (') prime. This form of carrying out is identical with the embodiment shown in FIGS. 1 and 2, however the air pump 11' is built integral with the cyclone 15' in order to make a compact construction that is easy to handle. The air stream from the outlet pip 9' in the top cover 3' is leading tangential into the cyclone 15', at the top of which turbine wheel 12', (which by its rotation procures the necessary vacuum,) is fitted to axle 25' common with the two liquid pumps 16' and 17'. All of these are driven by the common electric motor 26'. The rotation of turbine wheel 12' is increasing the turbulence in cyclone 15', which by means of the influence of the centrifugal force separates the liquid and the foreign matters from the air. The air subsequently escapes through an outlet pipe 27', which is positioned to extend through the hub 28' of the turbine wheel 12' which is attached thereto and to the axle 25' by means of one or more hubs and spokes 32'. The common axle 25' may be supported in the top by the bearing 29' on the bottom by bearing 30' and to the motor connected to [the] motor 26' by [a] flexible clutch 31'. The liquid pumps 16' and 17', the pipes 18' and 20', the nozzles 21' and 22' and also the hose connector 23', work in the same way as described with respect to the embodiment shown by FIGS. 1 and 2.

Figure 5:
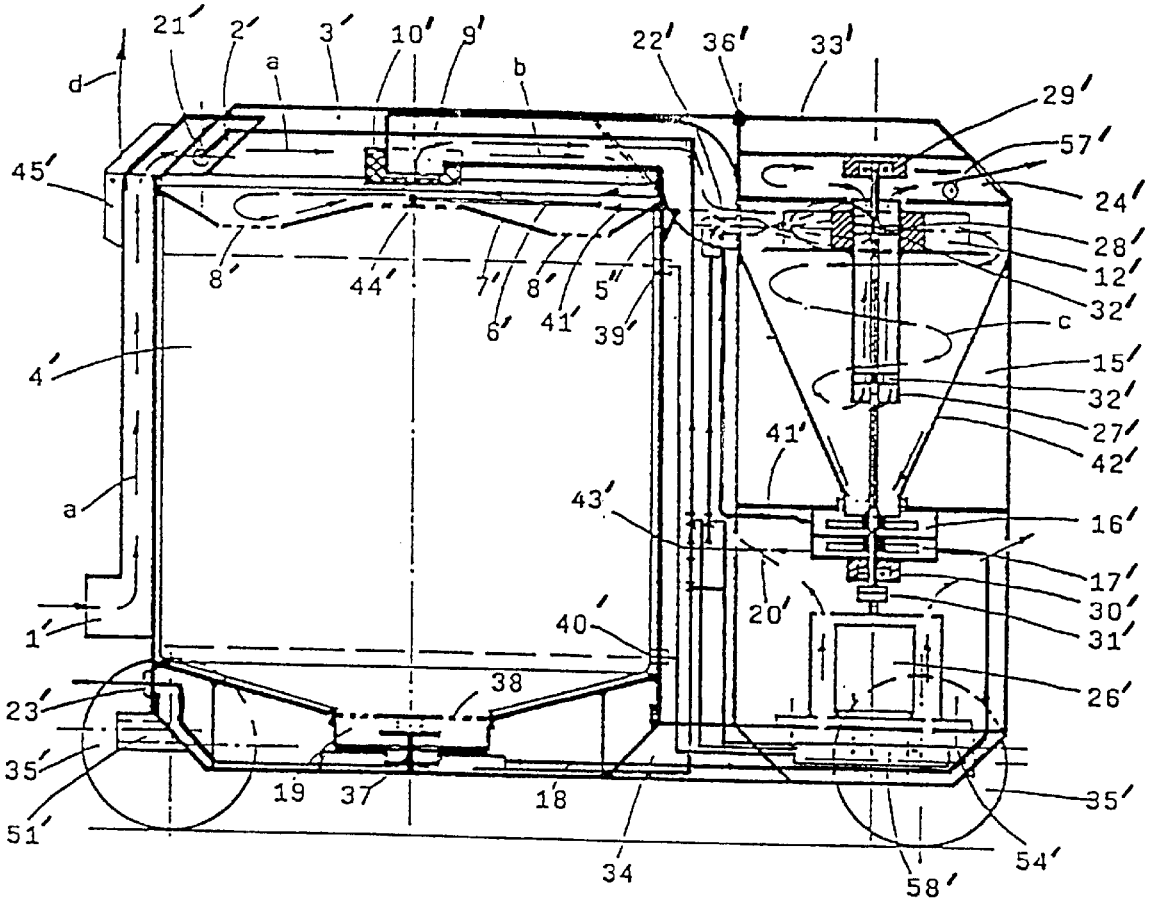
FIG. 5 of the drawings is a schematic side view of the second embodiment of the invention including a housing.
Figure 6:
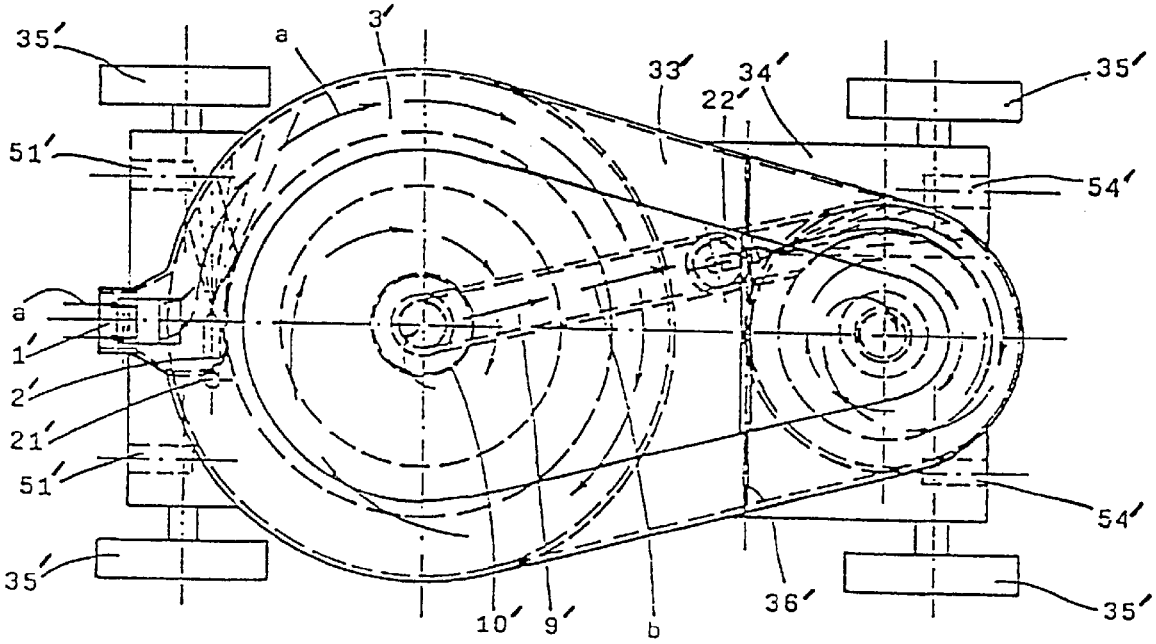
FIG. 6 of the drawings is a schematic top plane view of the second embodiment of the invention including a housing.

On FIGS. 5 and 6 is a variation of the second embodiment of the present universal vacuum cleaner. A cabinet 33' surrounds container 4' and cyclone 15', both of which are placed on bottom frame 34' having running wheels 35'. The top is closed by means of top cover 3', connected to cabinet 33' by means of hinge 36'. It is to be opened as shown by the arrow. It is kept closed watertight by means of locking device 45'.

The container section includes detachable liquid container 4', designed as a bucket which includes spout 5' and handle 6'. Inlet aperture 1' leads to circular top cover 3', in which immediately after entrance aperture 1' entrance elbow 2' is positioned, guiding the inlet air tangential, so that the air is circulating inside the cover in the direction] indicated by the arrows a. At the top of container 4' detachable pick up tray 7', including coarse filter 8', is positioned in order to pick up larger foreign matters, such as coins, matches, clips, nails and the like.

From the center of top cover 3, outlet pipe 9 which includes protective filter 10, leads the air into cyclone unit 15, in the direction indicated by the arrow b. Liquid container 4 is in the bottom and is provided with valve 19, which is provided with filter 38. Valve 19 keeps container 4 closed watertight, even when it is removed from cabinet 33. When positioned in the cabinets pin 37 which is placed in bottom frame 34, lifts the spring loaded disk valve from its seat whereupon the liquid from liquid container 4 freely can flow to suction piping 18. The maximum permissible level of liquid is container 4, is controlled by level control device 39, and minimum permissible level of liquid as controller by the level control device 40. Both are capable of stopping the motor 26, in case the upper or lower permissible level is exceeded. Within the limit, the user can decide the amount of liquid he wants to pour in the liquid container 4 before a cleaning operation.

Additionally, pick up tray 7 is secured against overflow if filter 8 is clogged by way of overflow opening 44.

The cyclone 15 includes cyclone housing 42, turbine wheel 12 and outlet pipe 27 which leads up through and is fastened to the hub 28 of the turbine wheel 12. The assembled unit is fastened to axle 25 by means of one or more hubs and spokes 32. The cross section of the spokes perform as ventilator blades, which promote the air stream up through outlet pipe 27, without promoting such a powerful air stream that would cause entrainment of liquid.

Axle 25' is fitted to bearing 29' and to bearing 30'. Below cyclone 42' is placed liquid pump 16', which may be a centrifugal pump. The conical end of the cyclone joins the central suction zone of the centrifugal pump 16'. Outlet pipe 41' leads therefrom into pick up tray 7', such that the liquid including foreign matters, which were separated by the cyclone 15', is pumped into the liquid container 4'.

Below liquid pump 16' is placed an other liquid pump 17', which may be of the high pressure type. The pump sucks the liquid through the suction piping 18' and valve 19' in the bottom of the container 4', thereby pressing the liquid through pressure piping 20' to control system 43' which by means of control box 58' directs the flow of liquid to nozzles 21' and 22' and hose coupling 23'. Control system 43' receives signals from feeler 57' via control box 58' to control the relative humidity at outlet opening 24'.

Figures 7, 8:
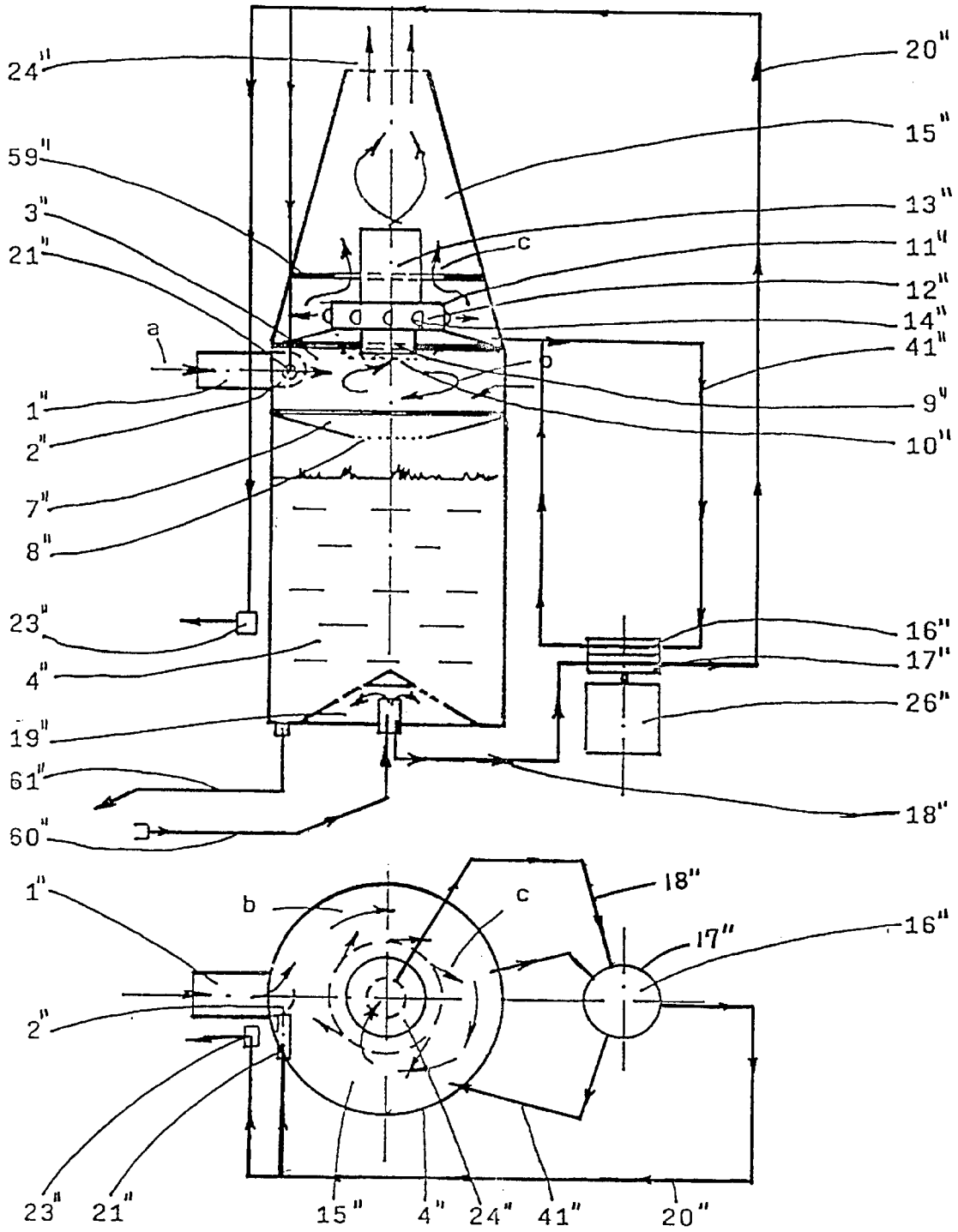
FIG. 7 of the drawings is a schematic side view of a third embodiment of the invention.
FIG. 8 of the drawings is a schematic top plan view of the third embodiment of the invention.

A compact third embodiment is shown in FIGS. 7 and 8. The separation of air from liquid and foreign matters is made in the same way as described in the previous but air pump 11" with turbine wheel 12" and electricmotor 13" is built integral with cyclone 15" and placed on the top of cylindrical top cover 3". Additionally, the inlet port of pump 11" is connected directly to outlet opening 9" of top cover 3" and cyclone 15" is placed surrounding airpump 1" with the pointed end facing upwards.

The pump house is provided with gill-slits which increase the air velocity and the centrifugal power. Moisture and foreign matters, which are not separated in the cylindrical top cover 3" and which can escape through the outlet opening 9" are forced against the conical walls of the cyclone, and slide down to the bottom of the cyclone and drained by hose 41" directly to liquid container 4", which is made possible to means of liquid pump 16", which is driven by motor 26". Cyclone 15" can be provided with baffle plates 59" to increase the efficiency of the separation, before the air escapes through the outlet opening in top 24".

The liquid container 4" is not made detachable for purposes of filling and emptying, but is drained through the outlet opening and hose 61", which is leading to a waste water outlet. The container 4" is filled up with clean water by means of another hose and hose connection 60". The liquid in the container 4" is sucked out through combined filter and connecting branch 19", through the pipe 18", the liquid pump 17", the pressure pipe 20" and finally to nozzle 21" and hose coupling 23". Every time liquid is filled into container 4", the sludge settled in the filter mesh is rinsed by inlet water hose 60". In this way the system is cleaned during use. Cyclone 15", including pump-unit 11", are hinged so that they, together, can be titled in order to take out the pick up tray 7" for cleaning thereof.

This compact design can also be used in combination with the previously described embodiments wherein liquid container 4", is made detachable.

FIG. 9 discloses the second embodiment shown in FIGS. 5 and 6, wherein the vacuum cleaner is fitted to vacuum cleaner nozzle 46' of the like described in Danish patent application DK 3015/90 and DK 0902/93, incorporated herein by reference, such a nozzle can be used to carry out the in the introduction described forms of cleaning operations. Vacuum cleaner nozzle 46' is connected to inlet aperture 1' by means of commonly known hoses and pipes 47'. Such commonly known hoses and pipes normally include an activating grip to control the supply of liquid to nozzle 46' through liquid hose 48', which, in turn, is connected to hose coupling 23'.

FIGS. 10 and 11 disclose the embodiment shown in FIGS. 5, 6 and 9, wherein the vacuum cleaner fitted with the above-described nozzle 46', is fastened by suspension 49', and constructed in such a way, that it can pivot around the horizontal axis 50' and so that it is spring-loaded. Such a nozzle more easily may pass through door steps and other small irregularities. Additionally, it will be understood that such a nozzle can be fitted to the bottom frame of vacuum cleaner 34' in openings 51', which are designed for that purpose. Inlet aperture 1' is connected to nozzle 46' by means of connecting pipe 52' and flexible hose 53'. In the opposite end of the bottom frame of the vacuum cleaner 34' openings 54' are positioned to accept pushing device 55', which may be designed as an u-bended pipe and provided with an operating rip 56' which can activate the functions of the vacuum cleaner. This combination of vacuum cleaner and nozzle is suitable for carpet cleaning and floor washing of larger areas.

What is claimed is:

1. A universal vacuum cleaner for cleaning all types of outside surfaces, the vacuum cleaner accepting air and foreign matter, including liquids, and exhausting air that has been substantially freed of the foreign matter, the universal vacuum cleaner comprising:

an inlet aperture for accepting air and foreign matter into the cleaner;

a liquid container having a top end and a bottom end;

a detachable pick-up tray positioned between the top end and the bottom end of the liquid container, the tray including a coarse filter positioned thereon, to, in turn, create a selective barrier between the top end and the bottom end of the liquid container;

a cylindrical top cover placed over the top end of the liquid container, the cylindrical top cover including an entrance elbow associated with the inlet aperture, the entrance elbow configured so as to direct the flow of air from the inlet aperture in a tangential direction around the cylindrical top cover;

a central outlet pipe extending through the center of the cylindrical top cover, the central outlet pipe including a filter positioned thereon;

an air pump associated with the outlet pipe, the air pump providing sufficient vacuum power to vacuum foreign matter into the inlet aperture;

an outlet opening associated with the air pump;

a suction pipe associated with the bottom of the liquid container and a liquid pump, the suction pipe directing liquid from the liquid container to the liquid pump, the suction pipe including a filter for selectively limiting the passage of at least some of the foreign matter in the liquid;

a pressure pipe associated with the liquid pump and a nozzle, the nozzle positioned within the entrance elbow to direct liquid tangentially around the cylindrical top cover, the nozzle further serving to direct liquid so as to moisten the foreign matter introduced through the inlet aperture; and a hose coupling associated with the pressure pipe for facilitating the ingress, or egress of liquid from the liquid container.

2. The universal vacuum cleaner according to claim 1 further comprising:

a cyclone associated with the outlet opening, the cyclone including a top end having an exhaust opening for facilitating the exhaust from the vacuum, at least a portion of the cyclone being substantially conical in shape;

a second nozzle positioned within the outlet opening, the second nozzle associated with the pressure hose, the second nozzle positioned to facilitate further moistening of the foreign matter which remains within the outlet opening, and to further direct the stream tangentially around the cyclone;

a second liquid pump associated with the bottom of the cyclone the second liquid pump facilitating the collection of liquid recovered from the cyclone;

an outlet pipe associated with the second liquid pump and with the liquid container, the liquid pump transferring liquid recovered from the cyclone back to the liquid container.

3. The universal vacuum cleaner according to claim 1 further comprising:

a cyclone integrally associated with the air pump and the outlet opening, the cyclone including a top end having an exhaust opening for facilitating the exhaust from the vacuum, at least a portion of the cyclone being substantially conical in shape;

the air pump further including a turbine wheel to promote the proper movement of air and foreign matter within the vacuum;

a second liquid pump associated with the bottom of the cyclone the second liquid pump facilitating the recovery of liquid from the cyclone;

an outlet pipe associated with the second liquid pump and with the liquid container, the onlet pipe transferring liquid recovered from the cyclone back to the liquid container;

the first liquid pump, the second liquid pump and the air pump rotatably attached to a common axle and driven by at least one common electric motor; and the outlet positioned about the common axle and rotatably attached to the common axle through at least one spoke, the turbine wheel of the air pump attached to an outside surface of the outlet.

4. The universal vacuum cleaner according to claim 1 further comprising:

a cyclone integrally associated with the air pump and the outlet opening, the cyclone including a top end having an exhaust opening for facilitating the exhaust from the vacuum, at least a portion of the cyclone being substantially conical in shape, the cyclone positioned on the cylindrical top cover and positioned such that the top end of the cyclone includes a diameter narrower than a bottom end of the cyclone;

the air pump including a circular ring having at least one gill-slit;

a drain hose associated with the lower end of the cyclone;

a second liquid pump associated with the drain hose, the second liquid pump facilitating the collection of liquid recovered from the cyclone; and an outlet pipe associated with the second liquid pump and with the liquid container, the liquid pump transferring liquid recovered from the cyclone back to the liquid container.

5. The universal vacuum cleaner according to claim 1 further comprising:

a vacuum cleaner nozzle unit having a nozzle spray system capable of applying liquid to the outside surface and at lest one suction pipe;

a pressure hose associated with the hose coupling and the nozzle spray system to provide liquid from the liquid container to the nozzle spray system; and a hose member associated with the suction pipe and the inlet aperture to facilitate return of the liquid into the inlet aperture.

6. The universal vacuum cleaner according to claim 1 further comprising:

a nozzle device having a fitting device which includes a suspension, the fitting device and, in turn, the suspension facilitating rotatable movement of the suspension around a horizontal axis;

means for biasing the suspension so as to generally maintain the suspension in a predetermined position relative the ground, thereby applying a suitable pressure onto the outside surface;

a flexible hose associated with the nozzle device and with the inlet aperture to direct air and foreign matter to the inlet aperture.

7. The universal vacuum cleaner according to claim 1 further comprising:

a housing member encapsulating at least a portion of the universal vacuum cleaner, the housing member including at least one fitting device; and a pushing device positioned within the fitting device, the pushing device including an operating handle, for controlling the universal vacuum cleaner.

8. The universal vacuum cleaner according to claim 1 further comprising:

a control device associated with the outlet opening, the control device capable of measuring the humidity of the air exiting the outlet opening;

means associated with the control device for controlling the amount of liquid directed to the spray nozzles, to in turn, set the humidity of the air exiting the outlet opening, to a desired predetermined level.

9. A universal vacuum cleaner comprising:

a cylindrical liquid container;

a cylindrical top cover positioned on the cylindrical liquid container, the cylindrical top cover having an elbow member positioned therein and associated with an inlet aperture;

a centrally placed outlet pipe positioned in the cylindrical top cover, the outlet pipe having a filter positioned therein;

at least one nozzle positioned within the elbow member, the nozzle operably associated with the cylindrical liquid container, and capable of directing liquid tangentially into the cylindrical top cover;

a detachable pickup tray positioned within at least one of the cylindrical top cover and the cylindrical liquid container, the detachable pickup tray having a coarse filter located therein;

an air pump associated with the centrally placed outlet pipe, the air pump capable of pulling air and foreign matter through the universal vacuum cleaner, the air pump having an exhaust region;

a liquid pump associated with the cylindrical liquid container and the at least one nozzle, the liquid pump capable of forcing liquid from the cylindrical liquid container through the at least one nozzle.

10. The universal vacuum cleaner according to claim 9 further comprising:

a cyclone having a first end associated with exhaust region of the air pump, to, in turn, direct the exhaust from the air pump tangentially around the cyclone from the first end toward the second end thereof;

an air output associated with the second region of the cyclone, the air output facilitating egress from the cyclone; and a second liquid pump associated with the second region of the cyclone, the second liquid pump collecting and returning any liquid collected within the cyclone to one of the cylindrical top cover and the cylindrical liquid container.

11. The universal vacuum cleaner according to claim 10 wherein a single electric motor provides power to each of the air pump and the first and second liquid pumps.

12. The universal vacuum cleaner according to claim 9 wherein the inlet aperture is associated with a vacuum cleaner nozzle for facilitating the ingress of air and foreign matter into the inlet aperture.

13. The universal vacuum cleaner according to claim 11 further comprising:

a spray nozzle associated with the first liquid pump, the spray nozzle operably positioned proximate the vacuum cleaner nozzle, and capable of spraying liquid onto the outside surface, to, in turn, loosen foreign matter from the outside surface and to facilitate ingress into the inlet aperture.

14. The universal vacuum cleaner according to claim 9 further comprising means for moving the universal vacuum cleaner on an outside surface.

15. The universal vacuum cleaner according to claim 14 wherein the moving means comprises a frame having at least three wheel members.

* * * * *